United States Patent [19]

Barker et al.

[11] Patent Number: 4,550,862

[45] Date of Patent: Nov. 5, 1985

[54] LIQUID PRODUCT POURING AND MEASURING PACKAGE WITH SELF DRAINING FEATURE

[75] Inventors: Dale E. Barker, Hamilton; Griscom Bettle, III; Robert H. Van Coney, both of Cincinnati, all of Ohio

[73] Assignee: The Procter & Gamble Company, Cincinnati, Ohio

[21] Appl. No.: 545,579

[22] Filed: Oct. 28, 1983

Related U.S. Application Data

[63] Continuation-in-part of Ser. No. 442,381, Nov. 17, 1982.

[51] Int. Cl.[4] ..... B67D 1/16

[52] U.S. Cl. ..... 222/109; 222/153; 222/549; 222/568; 222/571

[58] Field of Search ..... 222/108, 109, 111, 153, 222/424, 465 R, 468, 481, 488, 489, 544, 545, 548, 551, 553, 562, 567, 568, 549, 571; 215/218, 221, 330; 53/320

[56] References Cited

U.S. PATENT DOCUMENTS

| | | | |
|---|---|---|---|
| 1,274,867 | 8/1918 | Ford | 222/489 |
| 1,986,741 | 1/1935 | Moser | 222/551 X |
| 2,061,685 | 11/1936 | Wheaton | 221/147 |
| 2,356,755 | 8/1944 | Fazekas | 222/519 X |
| 2,601,039 | 6/1952 | Livingstone | 222/109 |
| 2,669,370 | 2/1954 | Royall, Jr. | 215/47 |
| 2,715,480 | 8/1955 | Livingstone | 222/111 |
| 2,763,403 | 9/1956 | Livingstone | 222/570 X |
| 2,785,839 | 3/1957 | DuPree | 222/479 X |
| 3,058,631 | 10/1962 | De La Hitte | 222/563 X |
| 3,079,022 | 2/1963 | Thompkins | 215/6 |
| 3,297,213 | 1/1967 | Henderson | 222/562 X |
| 3,300,104 | 1/1967 | Burt | 222/482 |
| 3,343,637 | 3/1969 | Marcel | 222/570 |
| 3,369,710 | 2/1968 | Lucas | 222/109 |
| 3,955,712 | 5/1976 | Santore | 222/484 X |
| 4,007,848 | 2/1976 | Snyder | 215/31 |
| 4,078,700 | 3/1978 | Hidding | 222/109 |
| 4,128,189 | 12/1978 | Baxter | 222/109 |
| 4,236,655 | 12/1980 | Humphries | 222/465 |
| 4,273,247 | 6/1981 | Earls | 215/228 |
| 4,298,145 | 11/1981 | Iida | 222/478 |
| 4,349,056 | 9/1982 | Heino | 141/381 |

FOREIGN PATENT DOCUMENTS

| | | | |
|---|---|---|---|
| 129658 | 10/1976 | Japan . | |
| D461760 | 6/1977 | Japan . | |
| 106092 | 4/1960 | Norway | 215/330 |
| 285650 | 1/1953 | Switzerland | 222/562 |
| 478064 | 1/1938 | United Kingdom . | |
| 1102863 | 2/1968 | United Kingdom | 222/562 |

*Primary Examiner*—Joseph J. Rolla
*Assistant Examiner*—Michael S. Huppert
*Attorney, Agent, or Firm*—Richard C. Witte; John V. Gorman; Ronald J. Snyder

[57] ABSTRACT

A liquid dispenser package is described which is adapted to dispense liquids without mess and which incorporates a measuring cup which is also the closure for the package. The package of the present invention includes a container having a dispensing orifice for storing the liquid product, a transition collar to be attached to the container finish surrounding its orifice and having an extended pouring spout and a transverse partition with drain to collect and return residual liquid to the container, and a measuring cup with an open mouth having threads on its exterior to attach the cup to the interior of the transition collar where it functions as the closure for the package. Because of the extended pouring spout, the residual liquid drain back feature, and the exterior threads on the measuring cup, virtually all mess normally associated with liquid product measuring and dispensing is obviated.

11 Claims, 10 Drawing Figures

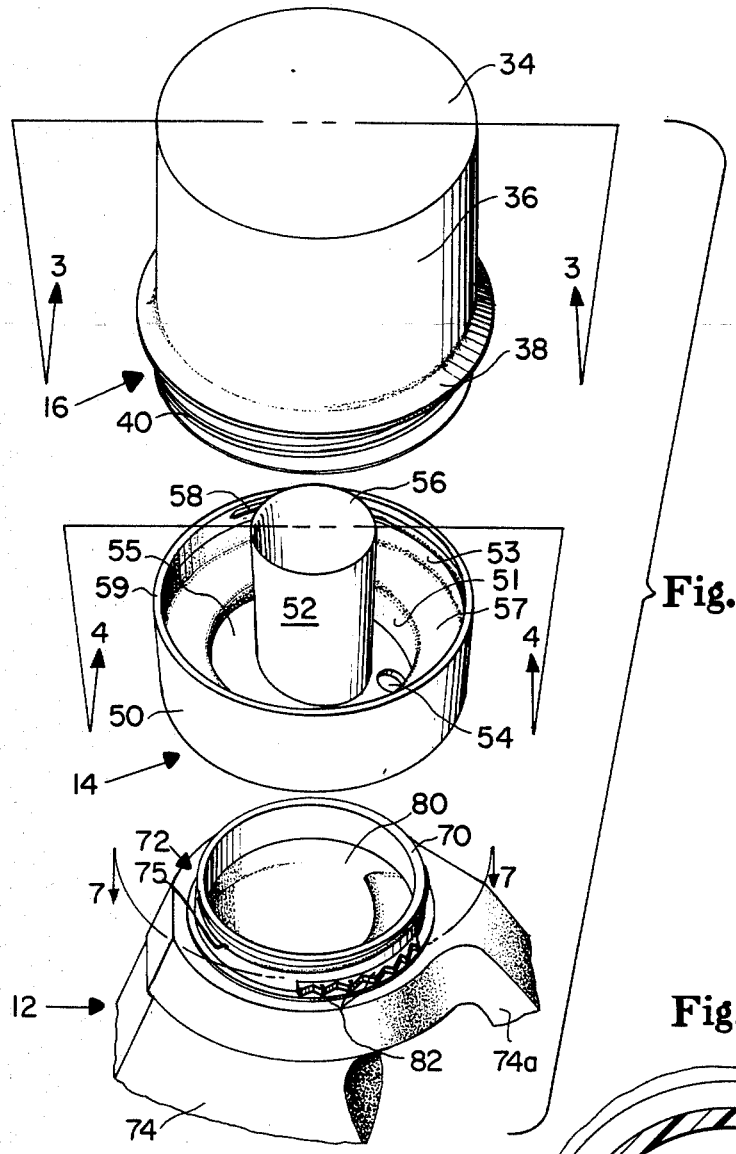
Fig. 2
Fig. 7
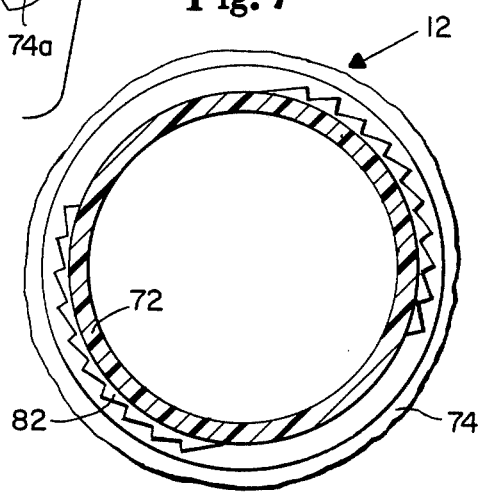

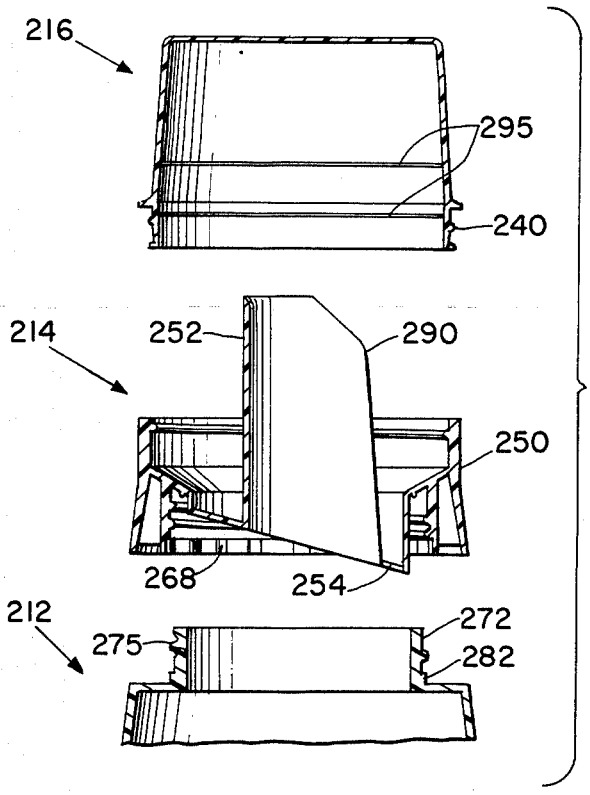
Fig. 9
Fig. 10
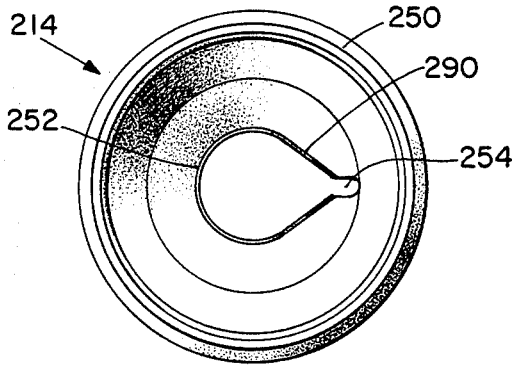

LIQUID PRODUCT POURING AND MEASURING PACKAGE WITH SELF DRAINING FEATURE

CROSS-REFERENCE TO RELATED APPLICATION

This is a continuation-in-part of prior copending application entitled "Liquid Product Pouring and Measuring Package with Self Draining Feature," Ser. No. 442,381, filed Nov. 17, 1982, in the name of the present applicants.

TECHNICAL FIELD

This invention relates to a dispensing package for liquid products, and, more particularly, to a package which includes a measuring cup which also serves as a closure.

BACKGROUND ART

A great deal of work has been directed to cleaning up the messiness generally inherent in dispensing liquid products from their containers. U.S. Pat. No. 3,369,710, which issued to M. B. Lucas on Feb. 20, 1968, for example, discloses a pouring fitment which frictionally engages the outlet of a bottle and includes a retractable telescoping spout member. A similar adapter arrangement, is disclosed in U.S. Pat. No. 4,298,145, which issued to M. lida on Nov. 3, 1981. In this latter patent, the antidrip adapter is formed by two concentric tubes integrally molded with an annular inclined guide plate connecting them.

A dripless pouring spout with a cooperating closure cap is disclosed by U.S. Pat. No. 4,078,700, which issued to W. E. Hidding on Mar. 14, 1978. In this patent, a pouring adapter similar to that of the described lida patent, but with the back portion of the tubular spout member open, incorporates a deformable antidrip finger and an annular inclined drip back surface to return excess liquid to the container. The cooperating closure cap member is formed with internal threads to mate with the external rib or thread of the container neck. U.S. Pat. No. 4,128,189, which issued to E. W. Baxter on Dec. 5, 1978, shows a pouring insert, very similar to those described in the patents of lida and Hidding, which is frictionally received and held in the neck of a dispensing bottle. In this patent, an insert cover is held in place by an annular cap whose internal threads mate with the external threads of the container.

Another dripless pouring spout comprising a pouring adapter with a closure cap is disclosed by U.S. Pat. No. 2,601,039, which issued to J. G. Livingstone on June 17, 1952. Livingstone describes a pouring adapter having an extended pouring spout with an open longitudinal slot on its rear surfaces, the spout being circumscribed by an inclined drainback surface which directs excess or spilled liquid back into the container. A cooperating cap for the adapter is to be frictionally or threadedly received on the upper exterior surfaces of the adapter.

Other prior work has been aimed at providing a liquid measuring device which also serves as the closure for the liquid container. U.S. Pat. No. 2,061,685, which issued to J. M. Wheaton on Nov. 24, 1936, discloses a closure with an integral measuring cap axially aligned therein and adapted to be applied with its open mouth extending substantially into the neck of the container bottle. The means for engagement with the container comprises an integrally formed annular flange having internal threads which mate with external threads on the bottleneck. An annular sealing ring is employed to insure a tight seal. U.S. Pat. No. 4,273,247, which issued to W. L. Earls on June 16, 1981, provides a closure-cup assembly having internal threads to mate with the external threads of the bottle or container. In this patent, the cup portion of the assembly is held in an inverted position encompassing and partially covering the exterior of said bottle or container when in the closed position.

A liquid container with a nondrip measuring cap is disclosed by U.S. Pat. No. 4,349,056, which issued to J. Heino on Sept. 14, 1982. A resilient insert telescoped in the neck of a container has a projecting annular lip is designed to scrape along the inner wall of the measuring cap closure to remove the residual liquid thereon as the cap is applied to the neck of said container. The measuring cap may be frictionally held in place, or may have internal threads on its internal surfaces adjacent its open mouth. As used herein, residual liquid is that which remains on a package surface after the liquid contacts it during the dispensing operation. This can include spillage, dripping, residue film and the like.

Despite all of the prior work done in this area, as evidenced by the above-cited patents, there remain problems of messiness and inconvenience when contained liquid product is to be dispensed into a relatively small measuring cup prior to use, especially when the measuring cup is to be replaced on the liquid container as its closure after such dispensing is completed. With prior art devices it was difficult, if not impossible, to avoid having residual liquid spread or drip onto exposed package surfaces unless the closure (and sometimes the spout) was rinsed clean after each use. Such residual liquid is unsightly, unpleasant to touch, and tends to retain dirt and dust thereon.

DISCLOSURE OF THE INVENTION

It is an object of this invention to obviate the above-described problems.

It is another object of the present invention to provide a liquid dispensing package which provides for the convenient, mess-free dispensing of measured quantities of said liquid, with a measuring cup which can be replaced on said container as its closure with no resulting mess or inconvenience.

In accordance with one aspect of the present invention, there is provided a liquid dispensing and measuring package, having a measuring cup which serves also as the closure device for the system, and which is adapted to allow mess-free, convenient, and economical dispensing and storage of a liquid product. The package includes a container comprising a body portion with an upwardly extending finish and a dispensing orifice. A transition collar mounted on the container finish has an outwardly extending pouring spout and a circumscribing wall having fastening means formed on its interior surface. A surface intermediate the spout and wall connects them and provides a means for conveying any spilled or residual liquid back to said container. A measuring cup has an open mouth terminating in a lip and is designed such that it is also the closure for said system. The cup has outwardly facing fastening means, such as threads or snap-fit protrusions, formed on its external surface adjacent said lip at its open end. The external fastening means on said measuring cup mate with the inwardly facing internal fastening means on the transition collar to attach and seal the cup in inverted condition.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

FIG. 2 is a fragmentary, exploded, perspective view of the embodiment of FIG. 1;

FIG. 7 is a horizontal cross-sectional view through the container finish taken below the means for attachment on the finish and showing the interlock means of the preferred embodiment;

FIG. 9 is a fragmentary, exploded, vertical cross-sectional view of the package of FIG. 8; and FIG. 10 is a top view of the transition collar of FIG. 9.

DETAILED DESCRIPTION OF THE INVENTION

Figure 1:
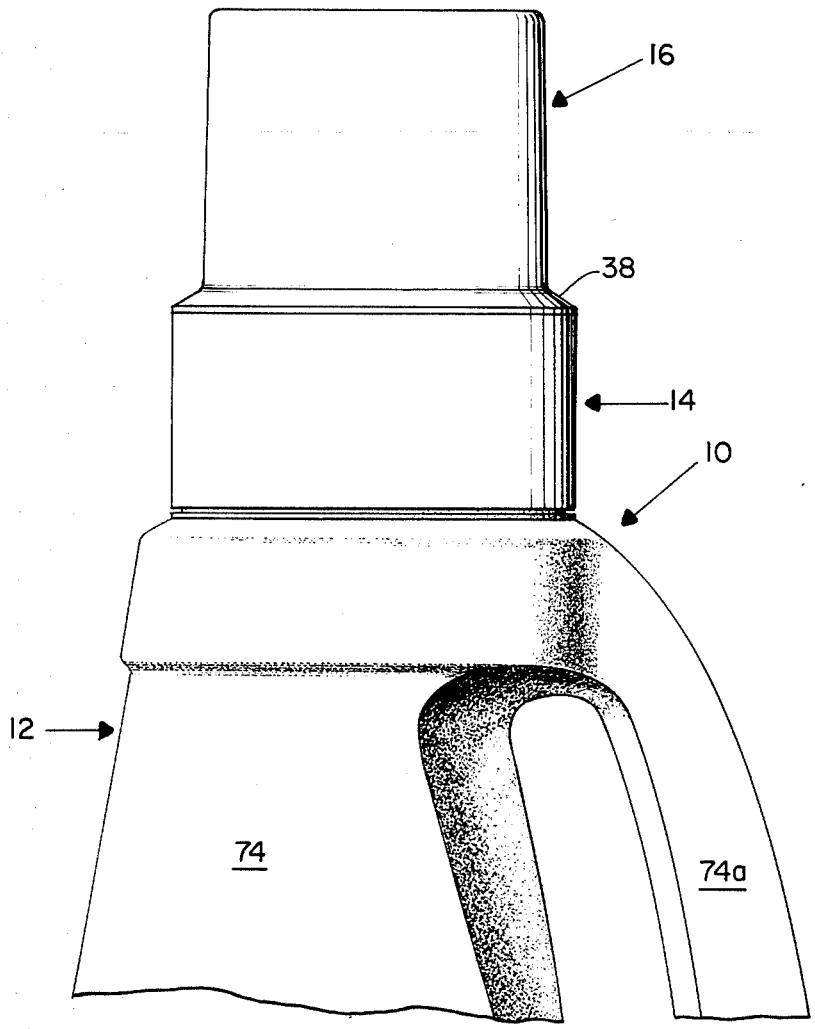
FIG. 1 is a fragmentary front elevational view of a preferred embodiment of the package of the present invention.

Referring now to the drawings in detail, wherein like numerals indicate the same elements throughout the views, there is illustrated a preferred embodiment of a liquid pouring and measuring package of the present invention. The package 10 includes a liquid product container 12, a transition collar 14 to be mounted on the container 12, and a measuring cup 16.

The container 12 is constructed of any moldable polymeric material, such as polyethylene or polypropylene, and has a body portion 74, an upwardly extending finish 72 and, as shown in FIG. 2, a flat annular lip 70 on the upper surface of the finish 72 defining orifice 80. The balance of the body portion 74 which is not shown in FIG. 1 may be of any desired configuration and provides a closed-end chamber suitable for containing the product to be dispensed. The preferred embodiment of said body portion 74 shown has an integrally molded handle **74*a* to provide a prominent or recognizable gripping or hand hold means to facilitate dispensing and to properly orient the transition collar 14 during pouring of the product, as will be more fully understood from the subsequent description. The orientation effect could also be achieved by other hand hold means known to those skilled in the art. For example, a discrete, palm-fitting area of the container which is ribbed or provided with knurl-like embossments could be molded into the body portion 74** to aid in gripping.

An interlock means, comprising a plurality of locking teeth 82, is located at the base of the container finish 72. These locking teeth 82 are shown best in FIG. 7 as being disposed in two diametrically opposed groups of several juxtaposed ratchet-type teeth 82 each, integrally molded around the base of the container finish 72 adjacent and below the thread convolutions 75 illustrated in FIG. 2. Since the preferred manner of forming the container 12 is blow-molding and since following the blow-molding process the two halves of the mold must be separated, the locking teeth 82 are formed so as not to interfere with the mold separation. As shown most clearly in FIG. 7, the locking teeth of the preferred embodiment are formed in two sets of 10 teeth 82, with the teeth 82 radially spaced ten degrees (10°) from each other. The sets are located apart on opposite sides of the mold parting line at the base of said container finish 72.

Transition collar 14 is preferably injection molded of a thermoplastic material, such as polypropylene or the like and desirably is slightly harder than the material of either the container 12 or the cup 16. This preferred variance in hardness provides better sealing between the collar and the container, and the cup and the collar, as will be discussed below. While even harder materials such as polystyrene materials can be used for the transition collar, polypropylene is preferred due to its better stress crack resistance.

Figure 4:
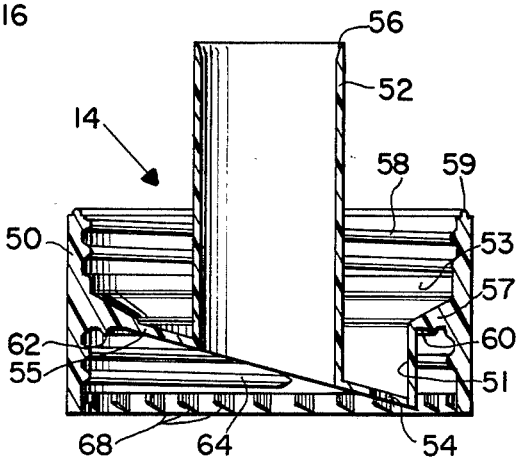
FIG. 4 is a vertical cross-sectional view of the transition collar of FIG. 2 taken along the line 4—4 thereof.

Transition collar 14 is best shown in FIGS. 2 and 4 as having a circumscribing cylindrical outer wall portion 50, an outwardly projecting tubular pouring spout 52, a drain-back shoulder 57 having a frusto conically configured upper surface and an inclined drain back partition 55. The drain back partition 55 and shoulder 57 essentially create a transverse partition which separates the outer wall portion 50 into top and bottom sections and has a vent/drain hole 54 extending through the lowermost portion of drain back partition 55. If desired, the vent/drain hole 54 can extend through the contiguous portion of wall 51 instead of through the drain back partition.

In the bottom section of transition collar 14, as best shown in FIG. 4, on the inner surface of the circumscribing wall 50 along the lowermost edge are a multiplicity of inwardly extending uniformly spaced locking teeth 68. The locking teeth 68 are integrally molded in the form of thin planar sections of material each of which lies at an angle of about 65° with a radial line intersecting its outermost extremity. The lower surfaces of the teeth 68 are upwardly inclined in an inward direction and the innermost surface of each is truncated at an angle which is approximately tangent to a circle connecting the inner ends of the teeth 68. The diameter of the circle is smaller than the diameter of a circle connecting the outer tips of the teeth 82 so that as the collar is applied, the teeth 68 must flex to slide past teeth 82. An interference of approximately 1.0 mm. between the teeth 68 and 82 has been found satisfactory. The teeth 68 are adapted to interlock with the locking teeth 82 of the container 12 and, in effect, perform a pawl-like function. It will be understood, however, that any means for fastening or interlocking the transition collar 14 against rotational movement relative to the container 12 in the unfastening direction may be employed. For example, a vertically oriented rib and groove interlock arrangement can be used. In the embodiment shown in FIG. 4, there are 24 locking teeth 68 uniformly spaced at 15° intervals around the inner periphery of the lower portion of circumscribing wall 50, so that when said collar is securely tightened into said container, every other locking tooth 68 of the transition collar will interlock with a locking tooth 82 in the container 74 and, therefore, restrict any rotation in the loosening direction. The resultant interlock action between said container and said collar will allow the measuring cup 16 to be removed and replaced on the upper portion of transition collar 14 without causing rotation of collar 14.

Adjacent and above locking teeth 68 in the bottom section of transition collar 14 are threads 64 which cooperate with threads 75 on container finish 72. Again, any means of mounting collar 14 on container 12 may be employed; however, where collar 14 has a drain back partition with a drain hole, such as vent/drain hole 54, the collar 14 desirably should be oriented so that users will not pour the contained liquid from both the spout 52 and the vent/drain hole 54 simultaneously, which would prevent proper venting and make it difficult to control the stream of product. In the described embodiment the threads 64 of the collar 14 and the threads 75 of the container 12 are designed and matched so as to mount the transition collar 14 onto container 12 and orient the vent/drain hole 54 so that it is generally radially aligned with and adjacent, e.g. within about 30° of, the hand hold means (handle 74*a*) when tightened. In tightened condition the annular sealing ring 62 on the lower surfaces 60 of drain back shoulder 57 of the collar 14 will contact and slightly deform or cut into the softer material of the flat lip 70 of container 12, thus creating a tight seal. As shown in FIG. 4, the annular lower surface 60 of the drain back shoulder 57 is substantially flat and at right angles with the axis of collar 14, so that the sealing ring 62 can fully contact flat lip 70.

Drain back shoulder 57 is integrally attached on its outer periphery to the inner surface of circumscribing wall 50, and its upper surface is inclined steeply toward the central axis of transition collar 14. The angle of inclination of the surface of shoulder 57 is not critical, but should be steep enough to facilitate gravitational movement of any residual liquid placed thereon toward the vent/drain hole 54. In the preferred embodiment the shoulder 57 is sloped at approximately 30° relative to the horizontal. The inclined drain back partition 55 is integrally attached to both the inner periphery of drain back shoulder 57, and the outer surface of the extended pouring spout 52. Because of the inclined nature of the partition 55, a truncated cylindrical drain back wall 51 provides the connection between the partition 55 and the inner periphery of said drain back shoulder 57 to complete the separation of the top and bottom sections of collar 14 in locations other than through vent/drain hole 54.

Figure 6:
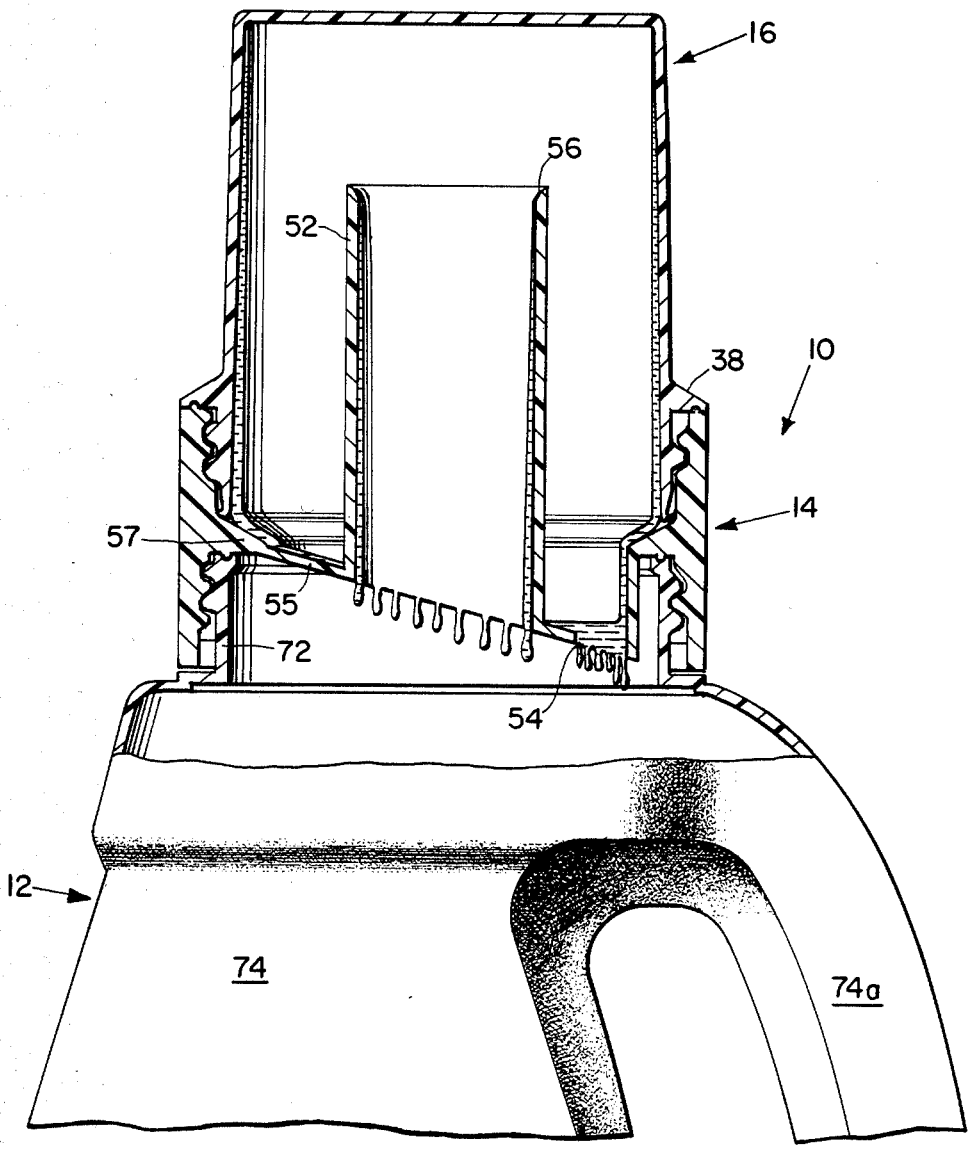
FIG. 6 is a fragmentary, vertical, partial cross-sectional view of the package of FIG. 1 in closed condition following dispensing.

In the top section, extended pouring spout 52 is coaxial of the transition collar 14 in the embodiment shown, however, the spout 52 could be located off-center or could be formed in a bent position, if desired, to aid in pouring. The diameter of pouring spout 52 is not critical and can be sized for convenience in pouring the particular liquid involved. The overall height of said spout 52 is also not critical, but must fit within said inverted cup 16 in the sealed position, as seen in FIG. 6, and should extend outwardly from collar 14 a sufficient distance to insure maximum dispensing and mess control, whether the container is completely full or partially empty.

The uppermost surface of spout 52 in the illustrated embodiment includes a lip 56 designed to minimize dripping action of liquid. In the preferred embodiment, lip 56 is formed by beveling or rounding-off the inner surface of the distal end of spout 52 to create a sharper conformation, as best seen in FIG. 4.

Adjacent to and above drain-back shoulder 57 and formed on the inner surface of the circumscribing wall 50, is an annular interior wall 53. Interior wall 53 has a diameter slightly smaller than the internal passageway elements formed above it and can be sized as to form an annular contact seal with measuring cup 16 when it is engaged with collar 14. Preferably annular wall 53 is tapered, so that its diameter adjacent shoulder 57 is smaller than its diameter at higher levels, to enhance its sealing capability. Above annular wall 53, also on the inner surface of said circumscribing wall 50 and adjacent its top surface, are formed a fastening means, inwardly facing threads 58, to receive the corresponding outwardly facing threads 40 of measuring cup 16 to be described. The top surface of circumscribing wall 50 is formed with a sealing ring 59 to contact and form a tight seal with cup 16 when the same is threadedly attached to collar 14. The heights of sealing rings 59 and 62, of course, should be designed to compensate for the various tolerances of the molded parts. Both will seal because of the interaction of the hard sealing ring pressing against or into softer sealing surfaces, as described above.

Figure 3:
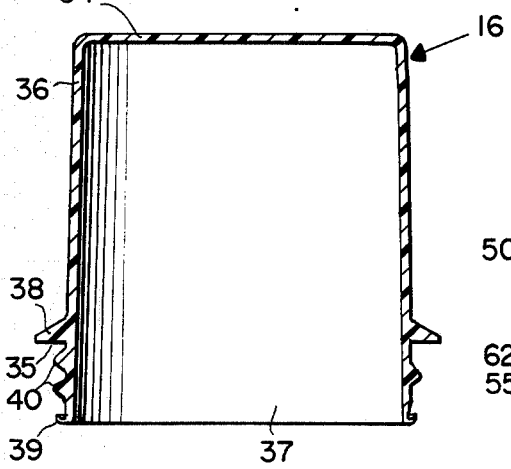
FIG. 3 is a vertical cross-sectional view of the measuring cup taken along the line 3—3 of FIG. 2.

The measuring cup 16 is shown in FIG. 3 as being generally cup-shaped with a bottom wall 34, a depending skirt-like sidewall 36, and an open mouth 37 terminating in a lip 39. Preferably, the cup 16 is injection molded of a fairly dense polymer, such as medium to high density polyethylene, for compressive strength. As discussed earlier, the preferred embodiment utilizes softer material for the container 12 and cup 16 to allow the sealing rings 62 and 59 on the collar 14 to slightly deform or cut into the mating surfaces.

As best shown in FIG. 3, lip 39 is formed as a drip-prevention lip for cup 16 when the same is used as a measuring cup, and to be an inner seal in contact with annular interior wall 53 of the collar 14 when cup 16 is used as the closure for the package 10. This is accomplished by having the lip 39 flare outwardly and terminate in a sharp edge. The sealing function of the lip 39 is best illustrated by the cross-sectional view in FIG. 6, showing the closed package following use. The particular configuration of the lip 39 can be modified by those skilled in the art to suit particular applications and need not be of an anti-drip variety.

Adjacent lip 39 on the external surface of said cup is an outwardly facing fastening means, threads 40, adapted to cooperate with the inwardly facing threads 58 of collar 14. While other types of fastening means can be employed, threads are preferred to insure a tight seal between the collar 14 and cup 16. The number and spacing of such threads is not critical so long as a reliably secure closed arrangement results.

A coaxial shoulder 38, located adjacent the side of the threads 40 spaced from the lip 39, projects outwardly from the exterior surface of sidewall 36 and provides a sealing surface 35 adapted to contact sealing ring 59 on the upper surface of circumscribing wall 50 of collar 14 when the measuring cup 16 is fastened in inverted condition on the collar 14. In the preferred embodiment, as can best be seen in FIG. 3, the substantially flat, annular sealing surface 35 of shoulder 38 extends radially from said sidewall 36 at approximately a 90° angle. The seal between cup 16 and collar 14 could also be accomplished in other ways such as providing an annular gasket (not shown) on the surface 35 or attaching such a gasket to transition collar 14. Such alternate methods of sealing would be preferred if cup 16 was snap-fitted or otherwise attached than by threads.

The width of projecting shoulder 38 should be sufficient to insure complete surface contact between ring 59 and sealing surface 35. The thickness of shoulder 38 is not critical, but should be such as to provide sufficient rigidity for surface 35 to insure a tight seal with the collar 14 as described above.

The portion of cup 16 extending below sealing surface 35, as shown in FIGS. 2 and 3, including threads 40 and drip prevention lip 39, are dimensioned so that the surface 35 will contact and seal with sealing ring 59 prior to any substantial contact of drip-prevention lip 39 with drip back shoulder 57 when cup 16 is threadedly attached to collar 14.

The dimensions and overall shape of cup 16 are functionally related to the dosage requirements of the liquid involved. The cup 16 should preferably have a volume slightly greater than the volume required as the dosage, and the exterior of said cup may be textured or formed in some way to facilitate tactile manipulation. For example, cup 14 can be provided with external ribs or other embossments to aid in gripping for removal or replacement. The interior of said cup can be formed with indicia (not shown with respect to cup 16) which indicates fill levels for measurement of the liquid product.

While the preferred embodiment shows the measuring cup 16 to be of substantially annular cross-section throughout, such annular cross-section is only essential in the areas near its open mouth where it must attach and seal with collar 14. Therefore, the configuration of the bottom wall 34 and the depending sidewall 36 above the sealing shoulder 38, as shown in FIGS. 2 and 3, could be varied as desired.

Figure 5:
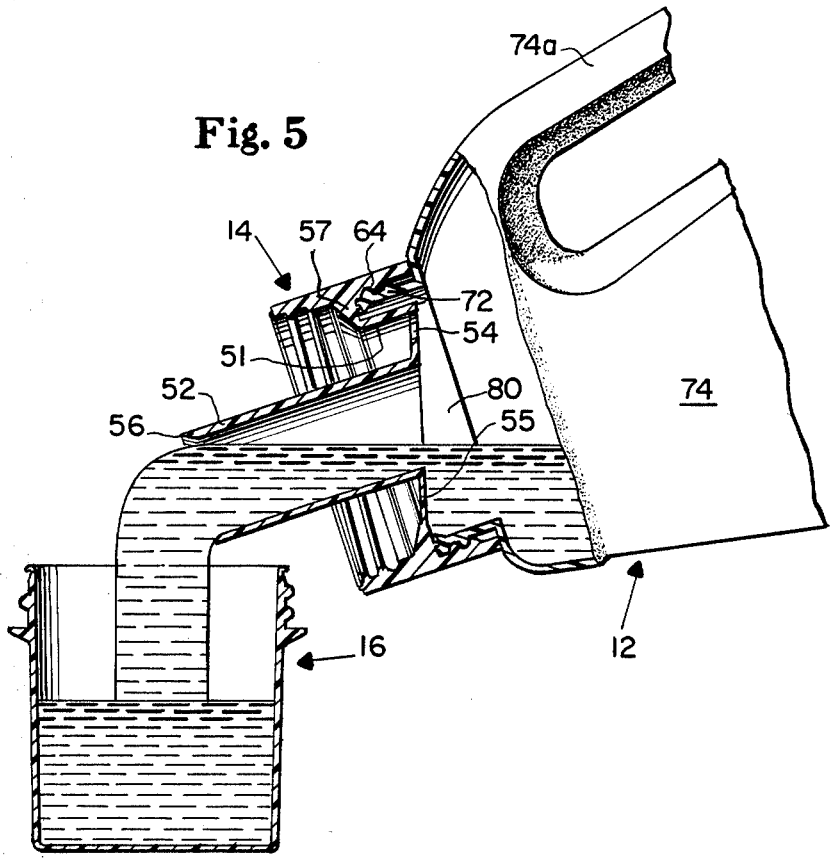
FIG. 5 is a fragmentary, vertical cross-sectional view of the package of FIG. 1 during the dispensing operation with the measuring cup performing its measuring function.

In use, the liquid product is placed in the container 12 and the transition collar 14 and measuring cup 16 are screwed down to sealing condition. During application of the measuring cup 16 onto collar 14, the seals therebetween are created by annular contact between sealing ring 59 and sealing surface 35, and between drip-prevention lip 39 and annular wall 53. The cup 16 can thereafter be removed by a user and employed as a measuring cup for dispensing liquid product as shown in FIG. 5. When cup 16 is filled to a desired level, container 12 is brought to an upright position and spout lip 56 will minimize the liquid which might otherwise drip therefrom. Any liquid which does drip from pouring spout 52 will run down its exterior surface and collect on the inclined drain back partition 55 and from there gravitate to the vent/drain hole 54 through which it will be returned to container 12 via orifice 80. When the liquid which was measured into cup 16 is dispensed therefrom, the drip-prevention lip 39 will minimize dripping over its edge. The user then inverts and replaces cup 16 on transition collar 14, screwing it down tightly. The resulting seal formed between sealing ring 59 and lip 35 and between the drip-preventing lip 39 and the annular wall portion 53 will prevent liquid product from escaping. It can be seen that if the package in the closed position, as shown in FIGS. 1 and 6, were knocked over, there would be no resulting leakage, and upon being returned to an upright position, any liquid in the collar 14 area would drain back into container 12.

FIG. 6 is a sectional view of the elements of the present invention in their sealed position after a complete use sequence, as described above. Any residual liquid in cup 16 will drain down onto drip back shoulder 57, gravitate toward the central axis of said collar, and along with any other collected residual liquid move along the inclined drain-back partition 55 to vent/drain hole 54 and therethrough into the container. The vent/drain hole 54 can be provided of various sizes and configurations, and, if desired, can be provided with baffles to interfere with product flow therethrough or to prevent visual access to the interior of the container 12. The size of the vent/drain hole 54, however, should be designed taking into consideration the liquid product viscosity and desired flow rate of the product to allow for sufficient influx of air during the pouring operation to facilitate smooth and steady dispensing, and to allow any collected residual liquid to be returned to said container relatively quickly after the package is returned to an upright position.

Figure 8:
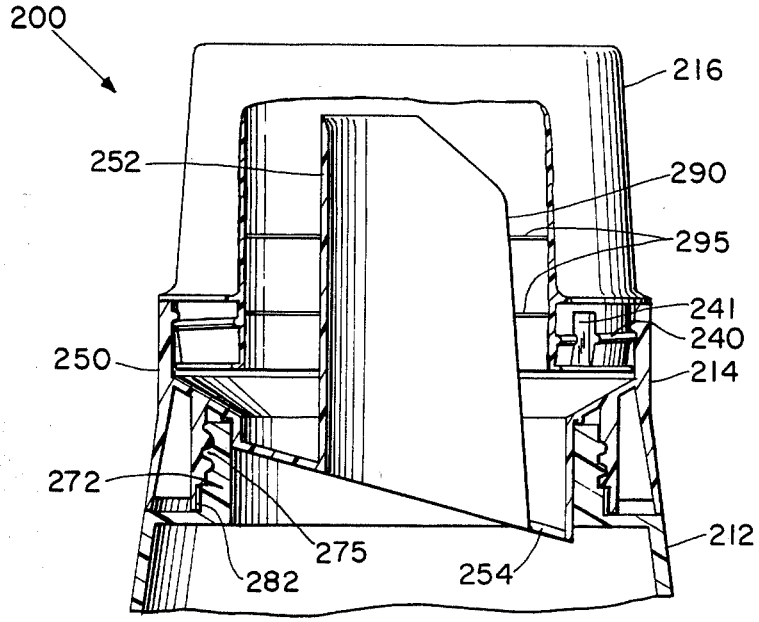
FIG. 8 is a fragmentary, vertical, partial cross-sectional view of another preferred embodiment of the package of the present invention, shown in assembled position.

FIGS. 8 through 10 illustrate an alternate and equally preferred liquid product pouring and measuring package. Particularly, FIGS. 8 through 10 illustrate package 200 comprising container 212, transition collar 214 to be mounted on container 212, and measuring cup 216.

Container 212 corresponds substantially identically to container 12, as described with regard to package 10, with the exception that the upwardly extending finish 272 of container 212 extends upwardly somewhat higher than did the corresponding finish 72. Interlocking teeth 282 and thread convolutions 275 correspond exactly to parts 82 and 75 of package 10.

Likewise, transition collar 214 corresponds substantially identically to transition collar 14, described above, except that pouring spout 252 is formed with an open backside 290, and drain/vent hole 254 extends from the open bottom of spout 252. Pouring spout 252 is shown as being located centrally with respect to the central axis of transition collar 214; however, it is contemplated that spout 252 could be located slightly off-center (not shown) to aid in pouring accuracy and convenience. Locking teeth 268 correspond exactly to locking teeth 68 described above with regard to transition collar 14. The lower portion of outer wall 250 of transition collar 214 is flared outwardly and downwardly to better conform to the shape of the upper portions of container 212. It is further contemplated that spout 252 and drain/vent 254 (and correspondingly spout 52 and drain/vent 54, as described above) could be formed with a thin removable membrane or tear strip (not shown) over their open portions for sealing of the package prior to initial use.

Measuring cup 216 also corresponds substantially identically with measuring cup 16, as described above. In FIG. 8 cup 216 has been only partially sectioned in order to show vent groove 241, which represents one means of venting and thus preventing or minimizing pressure buildup within package 200 during reattachment of cup 216 onto transition collar 214. Pressure buildup is preferably avoided as it may tend to force residual product through the cooperating fastening means between measuring cup 216 and transition collar 214 and onto the outer surface of package 200. Vent groove 241 is simply a channel or interruption of the external threads 240 of cup 216, which is of sufficient depth to permit air to escape from package 200 at least during the initial stages of application of cup 216 to transition collar 214. Other means of venting the package 200, such as a one-way valve, can also be used to prevent such pressure buildup. Similar grooves could also be incorporated on package 10, as described above. The interior of cup 216 is illustrated as including several fill level lines 295 as examples of indicia which can be used to indicate fill levels for measurement of the liquid product.

Various modifications of the described invention will be apparent to those skilled in the art. Examples of several such variations have been mentioned above, such as alternate means of nonrotatably mounting the transition collar on the container, and alternative ways of sealing various elements in a closed position. Accordingly, the scope of the present invention should be considered in terms of the following claims and is understood not to be limited to the details of structure and operation described and shown in the specification and drawings.

What is claimed is:

1. An improved package for liquids comprising:
(a) a container for housing a liquid and having an upwardly extending finish provided with a dispensing orifice;
(b) a transition collar mounted on the exterior of said container finish, said collar having an outwardly projecting pouring spout, a circumscribing wall with fastening means formed on its interior surface, said spout extending above and being spaced from said circumscribing wall to insure maximum dispensing and mess control and drain means for returning spilled liquid to said container; and
(c) a measuring cup adapted to serve as a closure, said measuring cup having an open mouth terminating in an anti-drip lip and having fastening means formed on its external surface surrounding said mouth, said external fastening means being adapted to cooperate with the fastening means on said transition collar to attach the measuring cup on the interior of said transition collar with the measuring cup in inverted condition.

2. The package of claim 1 wherein said fastening means for attaching said measuring cup on said fitment comprises threads.

3. The package of claim 2 wherein said fastening means formed on the external surface of the cup also includes an outwardly extending shoulder located adjacent the side of the threads spaced from said lip, said shoulder providing a sealing surface adapted to contact the upper surface of said circumscribing wall of said transition collar when said measuring cup is fastened in inverted condition on said transition collar.

4. The package of claim 2 wherein the transition collar is mounted on the finish with interlock means which resists relative movement between the transition collar and said container when said measuring cup is rotated for removal.

5. The package of claim 4 in which said interlock means comprises locking teeth formed on said transition collar and adapted to cooperate and interlock with oppositely disposed locking teeth formed on said container finish.

6. The package of claim 1, wherein the lip of said measuring cup is formed as a drip-prevention lip for said cup.

7. The package of claim 1, wherein said container is formed with hand hold means for grasping said container and said drain means comprises a transverse partition inclined toward a vent/drain hole extending through said transition collar, in which the vent/drain hole is generally radially aligned with and adjacent to said hand hold means for grasping said container.

8. The package of claim 7, wherein said hand hold means for grasping said container is an integrally formed handle.

9. An improved package for liquids comprising:
(a) a ontainer for housing a liquid and having an upwardly extending finish provided with a dispensing orifice;
(b) a transition collar mounted on the exterior of said container finish, said collar having an outwardly projecting pouring spout, a circumscribing wall with fastening means formed on its interior surface, said spout extend above and being spaced from said circumscribing wall to insure maximum dispensing and mess control, and drain means for returning spilled liquid to said container;
(c) a measuring cup adapted to serve as a closure, said measuring cup having an open mouth terminating in an anti-drip lip and having fastening means formed on its external surface surrounding said mouth, said external fastening means being adapted to cooperate with the fastening means on the interior of said transition collar to attach the measuring cup on said transition collar with the measuring cup in inverted condition; and
(d) means on said package for venting the package interior during application of said measuring cup to said transition collar.

10. The package of claim 9, wherein said means for venting comprises at least one groove formed through said fastening means on the external surface of said measuring cup.

11. An improved package for liquids comprising:
(a) a container for housing a liquid and having an upwardly extending finish provided with a dispensing orifice;
(b) a transition collar mounted on the container finish, said collar having an outwardly projecting pouring spout, a circumscribing wall with fastening means formed on its interior surface, and drain means for returning spilled liquid to said container; and
(c) a measuring cup adapted to serve as a closure, said measuring cup having an open mouth terminating in a lip and having fastening means formed on its external surface surrounding said mouth, said external fastening means being adapted to cooperate with the fastening means on said transition collar to attach the measuring cup on said transition collar with the measuring cup in inverted condition, said lip being formed as a drip-prevention lip for said cup and being adapted to seal against the inner surface of said circumscribing wall adjacent said internal fastening means when said cup is fastened in inverted condition on said transition collar.

* * * * *